US007975951B2

(12) United States Patent
Arnoff

(10) Patent No.: US 7,975,951 B2
(45) Date of Patent: Jul. 12, 2011

(54) SYSTEMS AND METHODS FOR MANAGING YARN

(76) Inventor: Mary Sara Arnoff, Lawrenceville, GA (US)

( * ) Notice: Subject to any disclaimer, the term of this patent is extended or adjusted under 35 U.S.C. 154(b) by 273 days.

(21) Appl. No.: 12/389,449

(22) Filed: Feb. 20, 2009

(65) Prior Publication Data

US 2009/0218245 A1 Sep. 3, 2009

Related U.S. Application Data

(60) Provisional application No. 61/030,840, filed on Feb. 22, 2008.

(51) Int. Cl.
*B65H 49/00* (2006.01)

(52) U.S. Cl. ..... 242/171; 242/172; 242/566; 242/588.2; 242/588.3; 242/127; 242/129; 66/1 A; 223/106

(58) Field of Classification Search ..... 242/170, 242/171, 172, 566, 588, 588.1, 588.2, 588.3, 242/127, 129, 134, 136, 137, 137.1, 138, 242/140, 141, 146; 66/1 R, 1 A; 206/389, 206/393, 394, 408, 409; 294/160–162, 152, 294/156, 167; 211/85.5; 223/106–109 A
See application file for complete search history.

(56) References Cited

U.S. PATENT DOCUMENTS

| | | | | | |
|---|---|---|---|---|---|
| 191,914 | A | * | 6/1877 | Beausoleil | 225/6 |
| 1,119,238 | A | * | 12/1914 | Brown | 242/146 |
| 2,169,297 | A | * | 8/1939 | Smith | 223/107 |
| 2,262,360 | A | * | 11/1941 | Gottlieb | 242/137.1 |
| 2,264,664 | A | * | 12/1941 | Hazel | 242/137.1 |
| 2,304,501 | A | * | 12/1942 | Hommer | 242/137.1 |
| 2,628,042 | A | * | 2/1953 | Fitts et al. | 242/146 |
| 2,780,399 | A | * | 2/1957 | Long | 223/107 |
| 3,084,788 | A | * | 4/1963 | Ford | 206/383 |
| 3,310,167 | A | * | 3/1967 | Knox | 242/593 |
| 4,004,745 | A | * | 1/1977 | Booth | 57/1 UN |
| 4,008,806 | A | * | 2/1977 | de Paez et al. | 209/606 |
| 4,108,397 | A | * | 8/1978 | Hauck | 242/137.1 |
| 4,330,095 | A | * | 5/1982 | Carter | 242/129.5 |
| 4,548,055 | A | * | 10/1985 | Macdonald | 66/1 A |
| 4,635,834 | A | * | 1/1987 | Lindquist | 223/107 |
| 5,544,831 | A | * | 8/1996 | Van Netta | 242/127 |
| 6,032,798 | A | * | 3/2000 | Bryant | 206/392 |
| D562,543 | S | * | 2/2008 | Van Blarcom | D3/23 |
| 2005/0194278 | A1 | * | 9/2005 | Barton et al. | 206/409 |

* cited by examiner

*Primary Examiner* — William E Dondero
(74) *Attorney, Agent, or Firm* — Sam S. Han

(57) ABSTRACT

Systems and methods for managing one or more yarn sources are disclosed. Namely, several embodiments of containers are disclosed, in which the container can be custom-configured to dispense yarn from one or more yarn sources with reduced tangling or knotting.

3 Claims, 14 Drawing Sheets

SYSTEMS AND METHODS FOR MANAGING YARN

CROSS REFERENCE TO RELATED APPLICATIONS

This application claims the benefit of U.S. provisional patent application Ser. No. 61/030,840, filed on 2008 Feb. 22, having the title "Accessory for Knitting and Crocheting with Multiple Yarn and Thread Management," which is incorporated herein by reference in its entirety.

FIELD OF THE DISCLOSURE

The present disclosure relates generally to knitting and crocheting, and more particularly to systems and methods of managing yarn.

BACKGROUND

Over the years, knitting and crocheting have become quite popular as a hobby, pastime, or even a personal business. As the craft has become more popular, the industry has developed specialty yarns for use in customized projects. Additionally, various knitting accessories have developed for use by a knitting or crocheting craftsperson, whether the craftsperson be using ordinary yarn or specialty yarn.

Despite the growth of the industry, there still exist needs that have not yet been addressed.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1C:
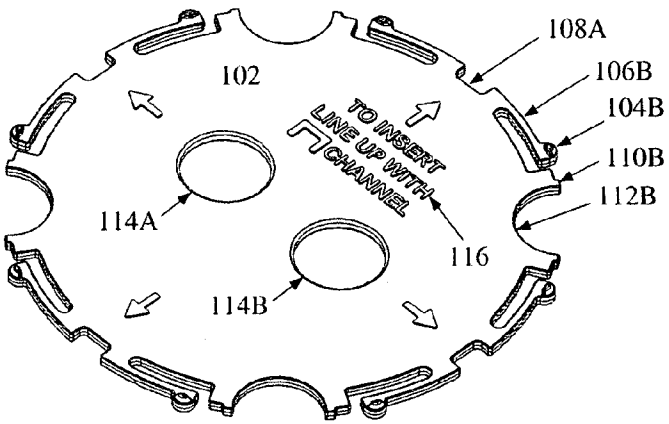
FIG. 1C shows a different perspective view of disc A.
Figure 1D:
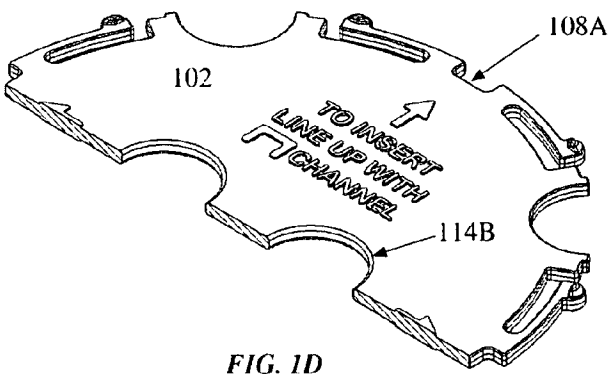
FIG. 1D shows a cross section view of disc A.
Figure 1A:
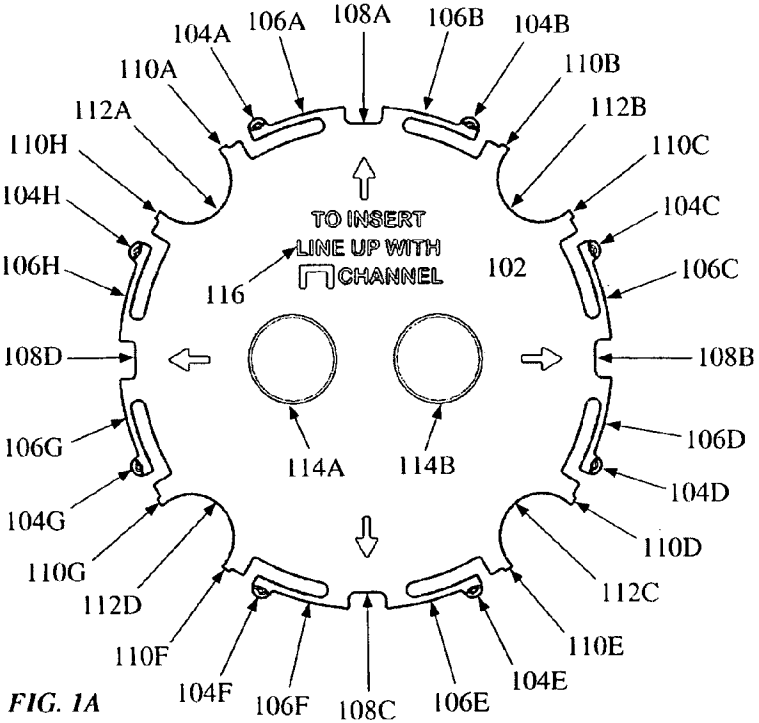
FIG. 1A shows a top view drawing disclosing components of a first disc ("disc A").
Figure 1B:
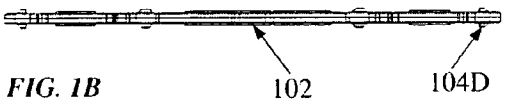
FIG. 1B shows a front view of disc A.
Figure 2C:
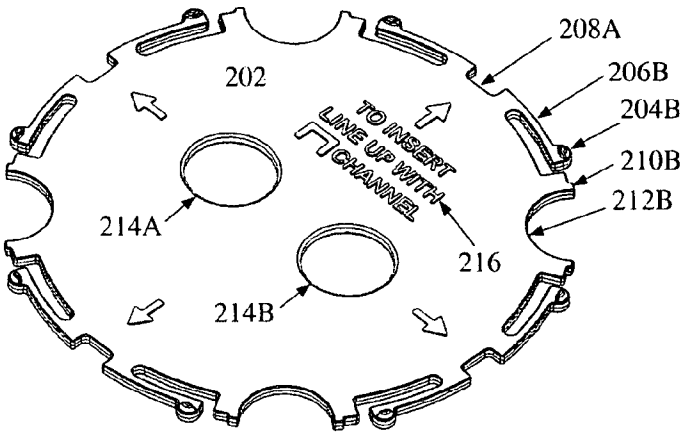
FIG. 2C shows a perspective view of disc B.
Figure 2D:
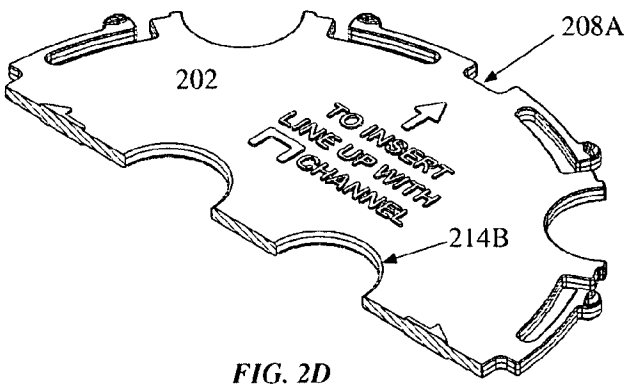
FIG. 2D shows a cross section view of disc B.
Figure 2A:
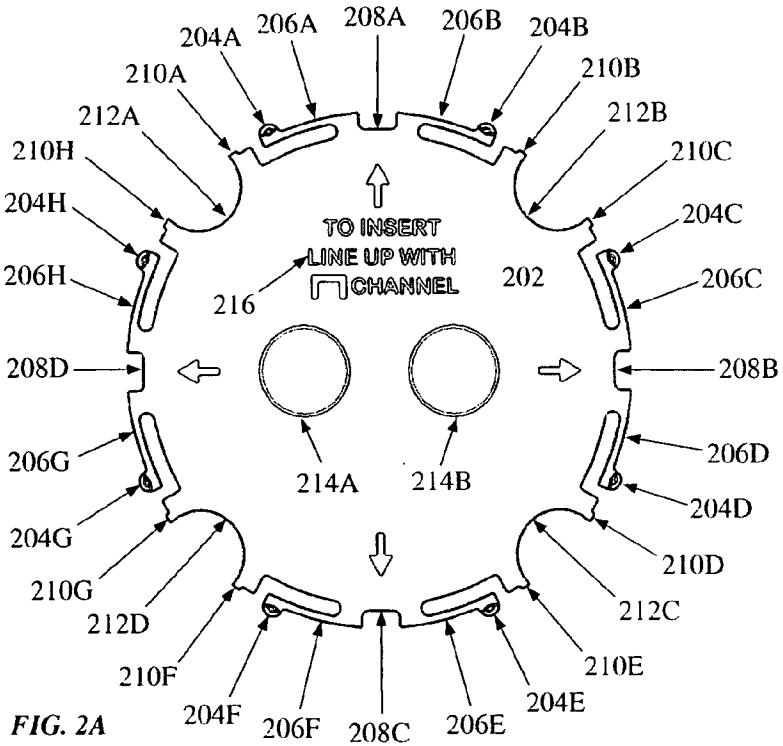
FIG. 2A shows a top view drawing disclosing components of another disc ("disc B").
Figure 2B:
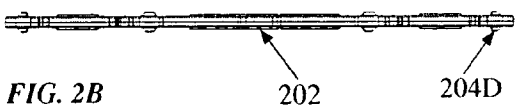
FIG. 2B shows a front view of disc B.
Figure 3C:
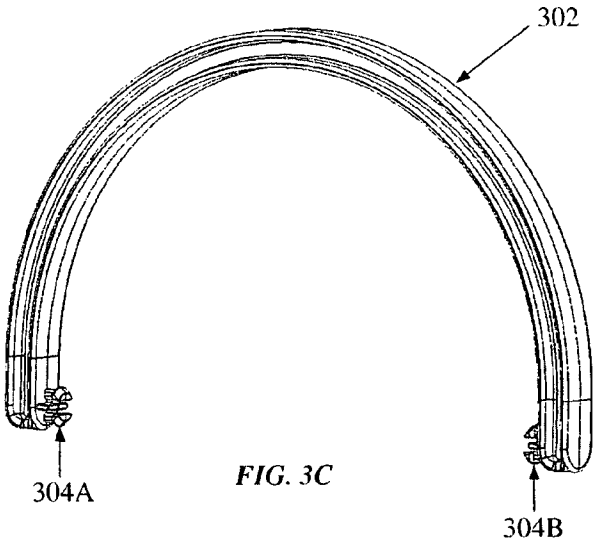
FIG. 3C shows a perspective view of the handle.
Figure 3D:
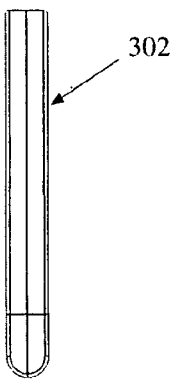
FIG. 3D shows a side view of the handle.
Figure 3A:
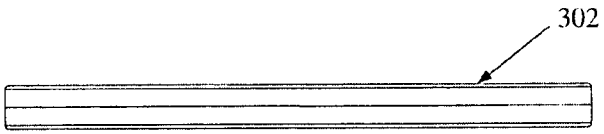
FIG. 3A shows a top view of a handle.
Figure 3B:
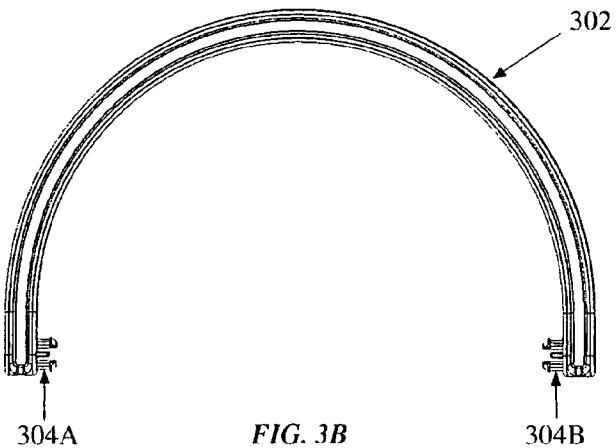
FIG. 3B shows a front view of the handle.

Reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

Creating a hand-crafted knit or crochet article involves yarn or thread. Yarn is available in a variety of formats, not limited to, skein, small ball, large ball, by-the-weight, hanks, and spools. Yarn can be 2-, 4-, 5-, 8-, 10-, 13-, or 14-ply. Ply references the "thickness" of each strand of yarn. The thinnest yarn is 2-ply and the thickest diameter of yarn is 14-ply.

Patterns for the various yarns sometimes require a project to be knit or crocheted with a single strand of yarn, or, knit or crocheted with two or more strands of yarn. The newer project patterns are aimed at a craftsperson who wants a project that can be completed quickly. These projects usually are worked with two or more strands of yarn. The craftsperson can use strands of the same yarn color, or, different colors yarns.

There is no standard method for preparing the manufacturer's yarn product for any given project. Each craftsperson determines how to convert the yarn product into a usable configuration. More often than not, the quickest, but not necessarily the simplest, method is to find the yarn beginning from the interior core of a skein. When found, the yarn beginning is pulled from the center of the skein. Another method includes, but is not limited to, unwinding the skein from the outside and winding the yarn end into a ball with the outer end from the yarn skein becoming the inside of the ball, and the interior of the yarn skein becoming the outside of the ball, and is the start end for the craftsperson's project.

A more experienced craftsperson can wind the yarn into a ball in such a configuration that presents the craftsperson two separate ends to enable a project entailing two separate strands to be used simultaneously from a single ball of yarn. One end is pulled from the center of the ball while the second strand is unwrapped from the outer end.

Regardless of the conversion method and subsequent yarn configuration, the craftsperson pulls the yarn end from the yarn source in the process of creating the project. The yarn is unwound from the source and worked into the project as the craftsperson progresses. It is common and unavoidable for the source portion of the yarn to roll around as the craftsperson pulls the yarn. This happens if the configuration is a ball or if the yarn is pulled directly from the skein. Another challenge of the un-winding characteristic of yarn is managing the yarn to prevent the multiple yarn source feeds from twisting or tangling together.

Newer novelty yarns are especially susceptible to twisting or tangling by virtue of the manufacturing process to combine the various textures that make up each yarn type. Many of these yarns have a texture, width, or other attribute that prevent them from being used in an accessory with a dispensing opening that is smaller in diameter than the yarn attributes require. Yarn widths may very from less than a quarter-of-an-inch (¼") to more than two-and-a-half inches (2.5") and may be composed of multiple strands of fiber.

When knitting or crocheting a project with a single or multiple strands of yarn, managing the various yarn sources can be cumbersome and time-consuming for the craftsperson. Both experienced and less skilled craftspersons can become quickly frustrated trying to cope with yarn sources rolling away, twisted yarn, and knotted tangles. The skilled and novice craftsperson spends considerable additional time trying to prevent yarn from twisting, tangling, and the source yarn rolling away as the yarn is pulled from the source for use in the project.

While there have long been accessories to carry the project components for working remotely and to store the components when the craftsperson is not actively working on the project, and more-recently accessories to dispense a single ball of a traditional yarn source, it appears the time-consuming and frustrating task of managing multiple yarn sources with a single accessory continues to be considered another skill required of the craftsperson as well as another component of the project. A single, low-center of gravity system that does not roll when the craftsperson pulls the yarn, manages the multiple yarn sources, accommodates diversity of yarn properties, is easy-to-use, and re-focuses the craftsperson's time to completing the project is desired.

Briefly described, one embodiment of the accessory comprises a molded, clear plastic cylinder fitted with vertical channels to hold two, plastic discs that can be fitted horizontally or vertically to separate the yarn sources. Each disc has four semi-circular punch-outs (or openings) positioned at approximately equal intervals around the periphery of the disc within which the yarn is placed when the craftsperson fits the disc horizontally over the yarn source. When the disc is fit vertically, up-right skeins are supported separately. Multiple yarn sources can be managed, or disbursed, simultaneously. The canister and base shape form a low center of gravity to reduce the phenomena of tipping over when the craftsperson pulls the yarn in the process of completing a project.

One embodiment of the invention provides the craftsperson a method to obtain two yarn sources from a single yarn skein, as well as eliminate the preparation time to convert the skein to a ball in order to use the exterior yarn end as a project source, a time-saving convenience previously not readily feasible due to the manufacturing methodology used to wind the yarn skein.

In yet another embodiment, the craftsperson can decide to create a ball configured with an internal yarn end feed as well as the standard external yarn end feed and insert a disc horizontally with each yarn feed maintained separately through one of four punch-outs. Positioning a second ball on top of the first horizontally placed disc and providing a second disc with each yarn feed maintained separately through one of the remaining punch-outs, aids the craftsperson in the completion of the project with four different yarn sources.

One embodiment of the accessory allows the craftsperson control of the yarn preparation method. Another embodiment of the accessory provides craftsperson flexibility to use this disclosure device to compliment the craftsperson's preferred method of dispensing yarn. The device, with yarn inside, can be used while sitting on the floor next to the craftsperson, while sitting next to the craftsperson or while held inside the craftsperson's utility tote. When used while held inside a utility tote, one embodiment of the accessory allows the yarn to be freely pulled without interference by the other contents of the utility tote.

Another embodiment includes punch-outs (or openings) located around the periphery of each disc to maintain separation of the yarn sources when the disc(s) is inserted horizontally.

Another embodiment allows the craftsperson to determine horizontal placement of each disc independent of the other disc. Controlling the disc placement over the yarn source ensures that each yarn source is isolated in an area adequate to support the innate movement of the yarn source and maintain the separation of each yarn source feed to prevent tangling of the separate yarn sources when yarn is pulled by the craftsperson. The devices described herein shield the yarn source from curious and playful observers such as cats, dogs, and children. Additionally, the devices described herein protect the yarn source from coming in contact with dirt, dust, and pollutants generally exposed on floors and other work surfaces.

Another embodiment provides the craftsperson easy access to the yarn sources to untangle a yarn strand that catches on the source as the yarn is pulled in the process of creating the project. It is not necessary for the craftsperson to sever, or cut, the yarn strand from the source to free the strand from the accessory in order to untangle the strand, as is occasionally required if the yarn was fed through a hole in the accessory top. It is an acceptable practice for a manufacturer to prepare a specified skein length or other measure of yarn by knotting two of more lengths together. Thus, as the craftsperson pulls the yarn, a knot can unexpectedly appear. If the craftsperson is using an accessory where the yarn is fed through a hole, the knot could abruptly stop the yarn feed forcing the craftsperson to stop working on the project and remedy the blockage. The punch-outs used in several of the devices described herein are designed to allow such knots to pass unaided without creating a blockage.

Several unique elements of the devices described herein (e.g., vertical channels molded in the canister, yarn feed punch-outs, tension arms of the discs, interchangeable vertical or horizontal disc configuration and disc storage, etc.) make for a unique accessory.

Prior to describing in great detail the interaction between each of the components and sub-components of the preferred embodiments, as shown in the drawings, it is worthwhile to identify the individual components for the purposes of clarity. With that said, attention is turned to each of the drawings.

FIGS. 1A through 1D show one embodiment of a disc 102, which can be used to separate yarn sources (not shown). In this embodiment, the disc 102 includes a plurality of notches 108A, 108B, 108C, 108D (collectively referred to herein as 108). In a preferred embodiment, there are four (4) total notches 108, that are located approximately equidistant from each adjacent notch 108, mainly, at the 3 o'clock, 6 o'clock, 9 o'clock, and 12 o'clock positions along the disc 102 periphery. As described in greater detail below, these notches 108 are used as guides. In addition to the notches 108, the preferred embodiment of the disc 102 also includes tension bars 106A-106H (collectively referred to herein as 106), each of which has a ball-shaped end 104A-104H (collectively referred to herein as 104). These tension bars 106 provide for a friction-fit of the disc 102, as described below. The preferred embodiment of the disc 102 also includes punch-outs (or openings) 112A-112D (collectively referred to herein as 112) that are located around the periphery of the disc 102. There are also, preferably, extruding components 110A-110H (collectively referred to herein as 110) on both sides of each punch-out 112 to define the opening 112 for dispensing yarn, as described in greater detail below. The punch-outs 112 provide an opening for dispensing one or more yarn sources, as described in greater detail below.

FIGS. 2A through 2D show components of a second disc 202. In a preferred embodiment, the second disc 202 is substantially identical to the first disc 102 and is interchangeable with the first disc 102. As such, the second disc 202 also includes components 204, 206, 208, 210, 212 that correspond to the components 104, 106, 108, 110, 112 of the first disc 102. Since those components 104, 106, 108, 110, 112 are described above with reference to FIGS. 1A through 1D, that description will not be duplicated here. However, it should be noted that the second disc 202 need not be identical to the first disc 102 for other embodiments, so long as, functionally, either disc can separate multiple yarn sources.

FIGS. 3A through 3D show a preferred embodiment of a handle 302. In the preferred embodiment, the handle has a semi-circular shape and includes elements (or snaps) 304A, 304B (collectively referred to herein as 304) that are configured to mate with corresponding holes, as described below.

Figure 4A:
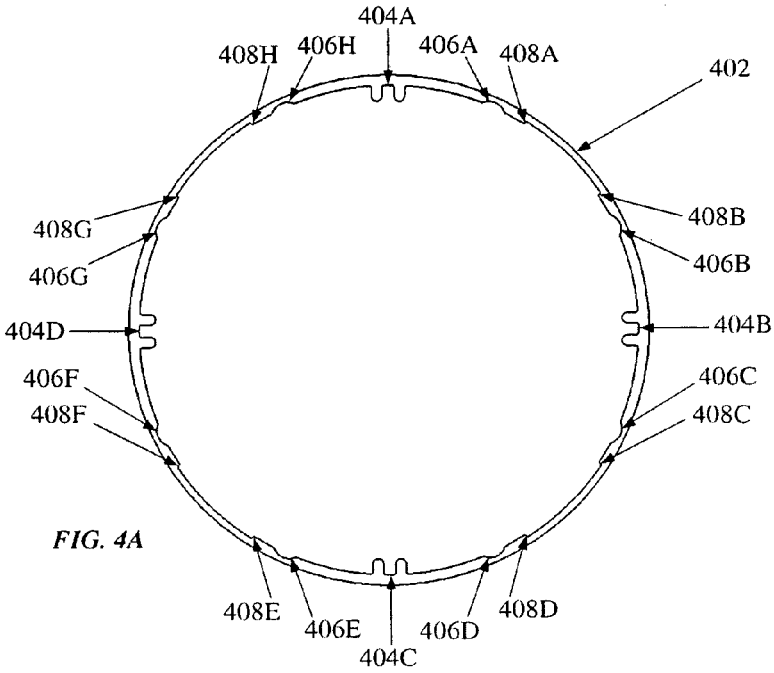
FIG. 4A shows a top view of a canister disclosing several components.
Figure 4B:
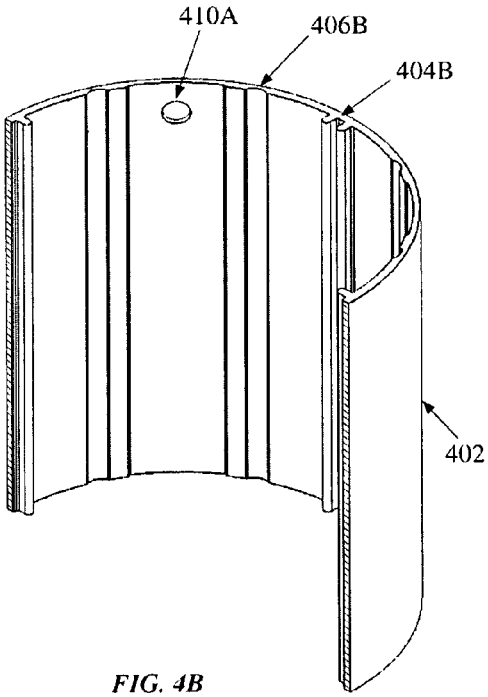
FIG. 4B shows a cross-section perspective view of the canister.
Figure 4C:
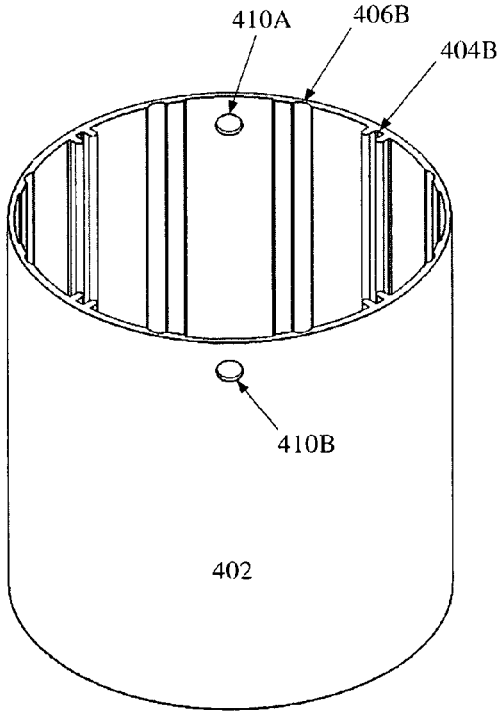
FIG. 4C shows a side perspective view of the canister.

FIGS. 4A through 4C show a preferred embodiment of a canister 402. In this preferred embodiment, the canister 402 takes on a substantially cylindrical shape with a substantially round base. However, it should be appreciated that the canister 402 can take on other cylindrical shapes or prism-like shapes having other geometric shapes that define its base. The canister 402 shown herein includes channels 404A-404D (collectively referred to herein as 404), which extend vertically along the inside wall of the canister 402. For this particular embodiment each channel 404 extends the entire height of the canister 402. However, it should be appreciated that the channels 404 need not extend along the entire height. For this embodiment, there are the four (4) total channels 404, that are located approximately equidistance from each adjacent channel 404, namely, at the 3 o'clock, 6 o'clock, 9 o'clock and 12 o'clock positions along the inside wall of the canister 402. As such, each channel 404 corresponds to a notch 108, 208 on one of the discs 102, 202, and for some embodiments the channels 404 are configured to guide the horizontal insertion of the discs 102, 202 into the canister 402 by slidably mating with their corresponding notches 108, 208. For other embodiments, the channels 404 provide a guide for the vertical insertion of the discs 102, 202. On the inside wall of the canister 402, there also exist additional channels 406A-406H (collectively referred to herein as 406), which are configured to slidably mate with the ball-shaped ends 104, 204 on the tension bars 106, 206 of the discs 102, 202 as the discs are inserted horizontally into the canister 402. As the ball-shaped ends 104, 204 insert into their corresponding channels 406, the tension bars 106, 206 provide a friction-fit of the discs 102, 202 to prevent them from easily slipping. On the inside wall of the canister 402, there also exists additional stop-notches 408A-408H (collectively referred to herein as 408) which are configured to slidably mate with extruding components 110 to define the opening 112 for dispensing yarn. The canister 402 also includes holes 410A, 410B (collectively referred to herein as 410) for receiving the corresponding elements (or snaps) 304 on the handle 302. It should be appreciated that for both the canister 402 and the discs 102, 202, the number and position of all of the components may be varied without detrimentally affecting the function of the accessory. While discs 102, 202 are shown in the preferred embodiments, it should also be appreciated that other dividers can be used to separate the yarn sources.

FIGS. 5A through 5E and 7A through 7C show preferred embodiments of a base 502. The preferred embodiment of the base 502 includes a bottom 504 and four (4) brackets 506A-506D (collectively referred to herein as 506). The brackets 506 are configured to mate with the bottom of the canister 402 to provide an enclosure for yarn sources. In a preferred embodiment, the base 502 is friction-fit to the canister 402 via the brackets 506. However, it should be appreciated that other mating techniques can be used, such as a clip or snap, without affecting the function of the base 502. For other embodiments, the base 502 also includes a storage area 512 that can hold the discs 102, 202. Similar to the channels in the canister 402, the base 502 includes several channels 510A-510D (collectively referred to herein as 510) which allow the ball-shaped ends 104, 204 of the discs 102, 202 to snap into place. In the preferred embodiment, the base 502 also includes a ridge 514 that prevents the discs 102, 202 from easily falling out of the storage area 512.

Figure 6A:
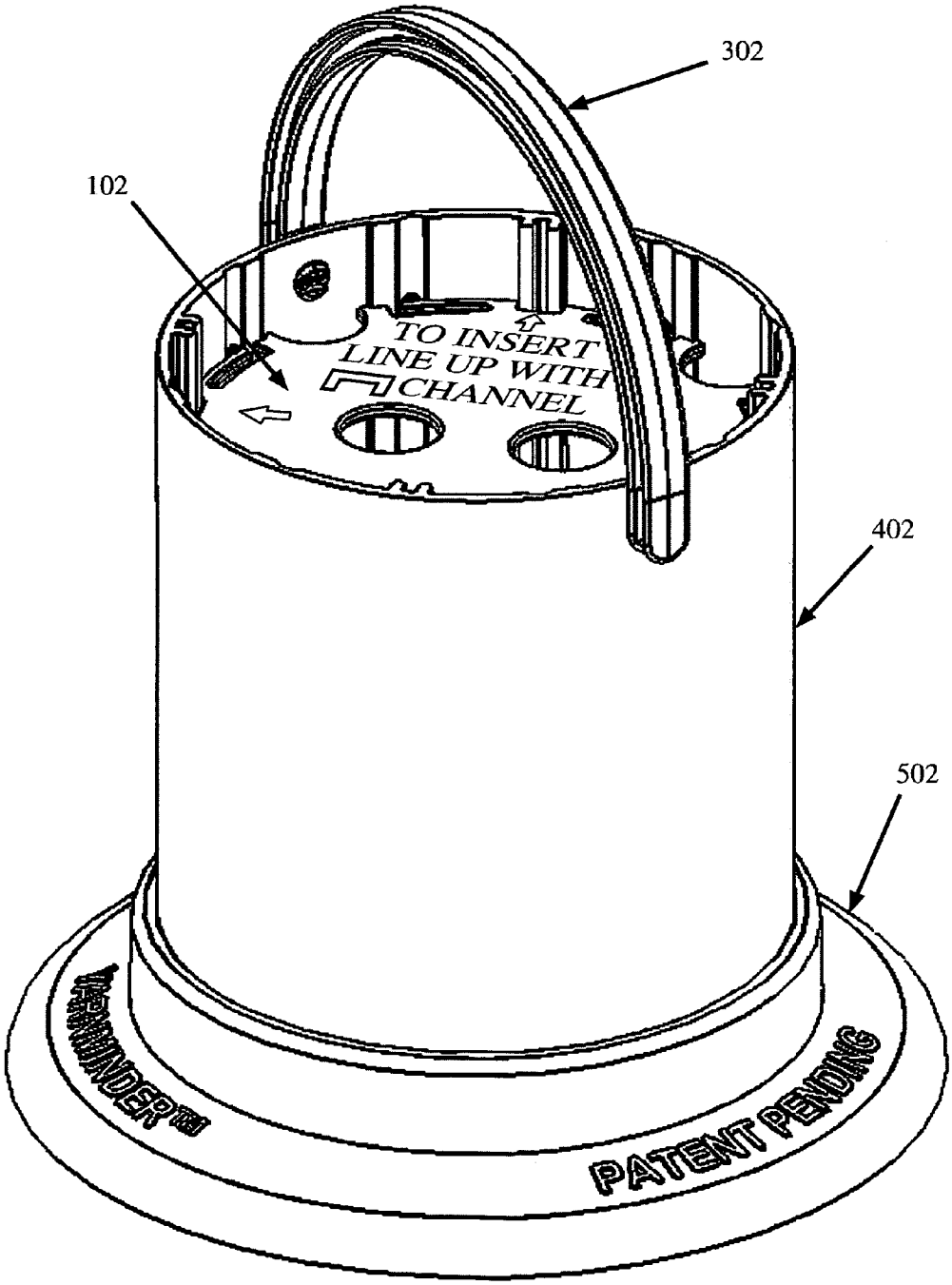
FIG. 6A shows a perspective view of one embodiment.
Figure 6B:
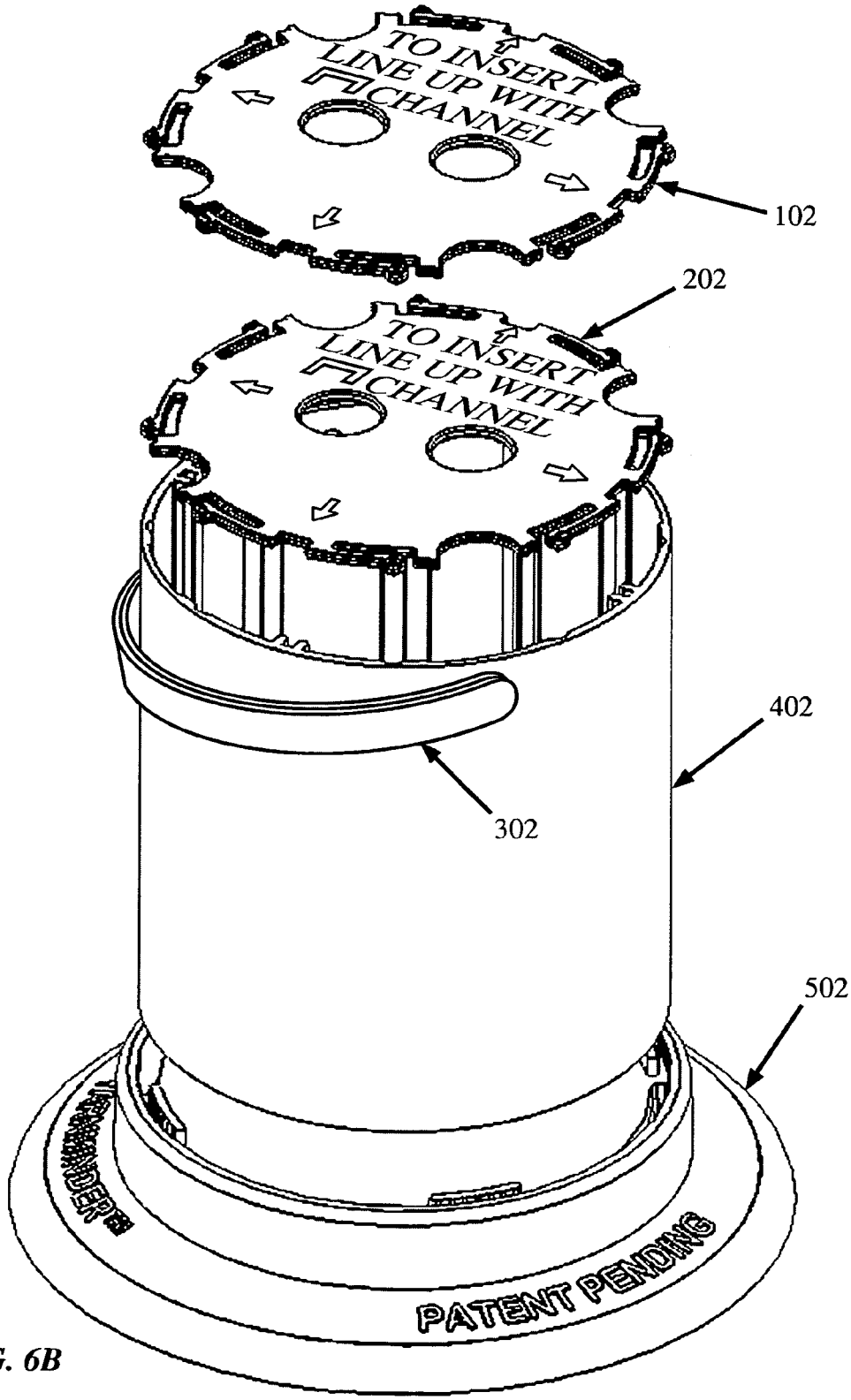
FIG. 6B shows an exploded view of the embodiment of FIG. 6A.
Figure 6C:
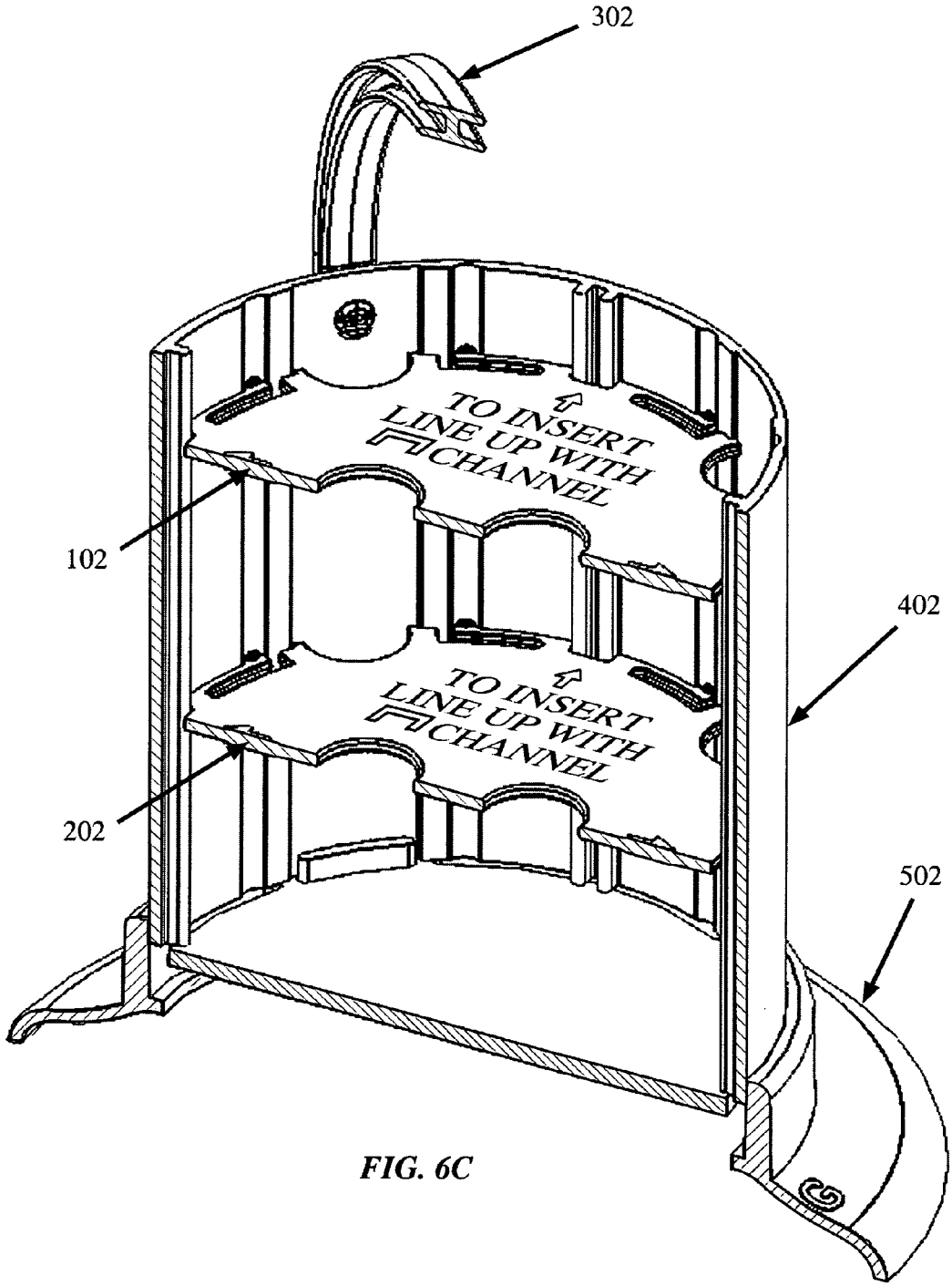
FIG. 6C shows a cross-section perspective view of the embodiment of FIG. 6A.
Figure 7A:
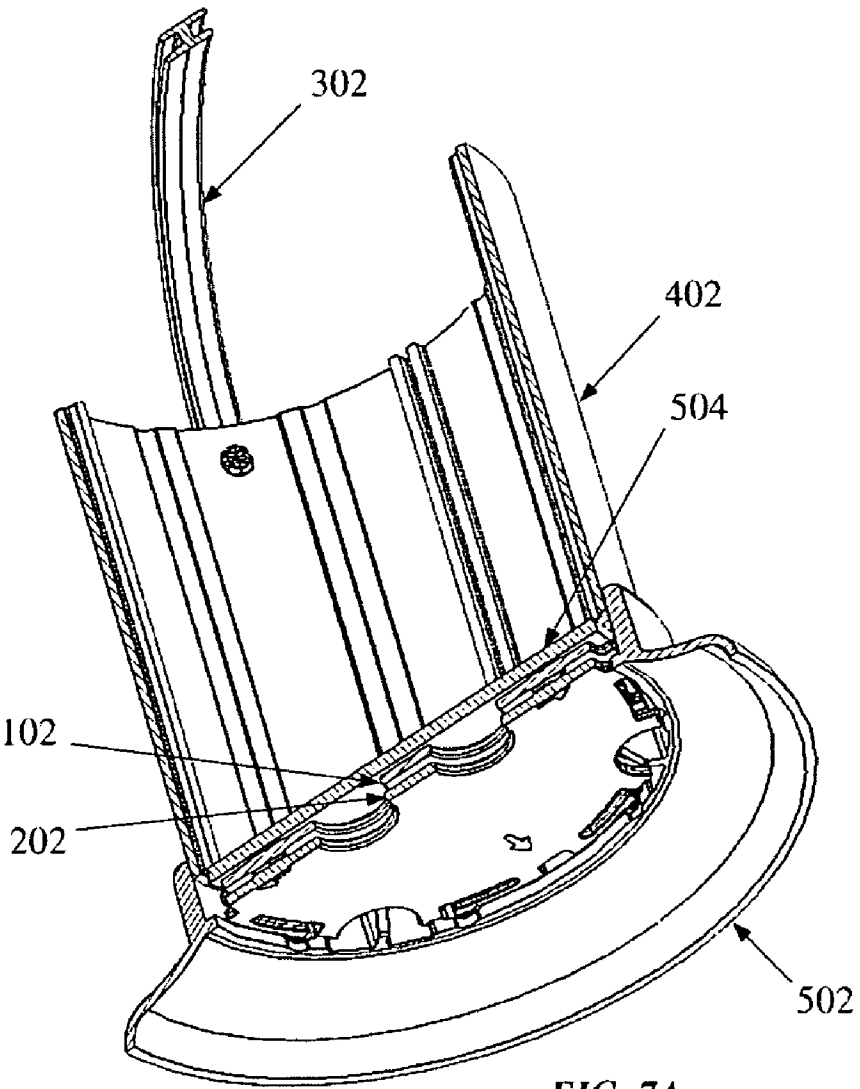
FIG. 7A shows a cross-section perspective view disclosing components of the base.
Figure 7B:
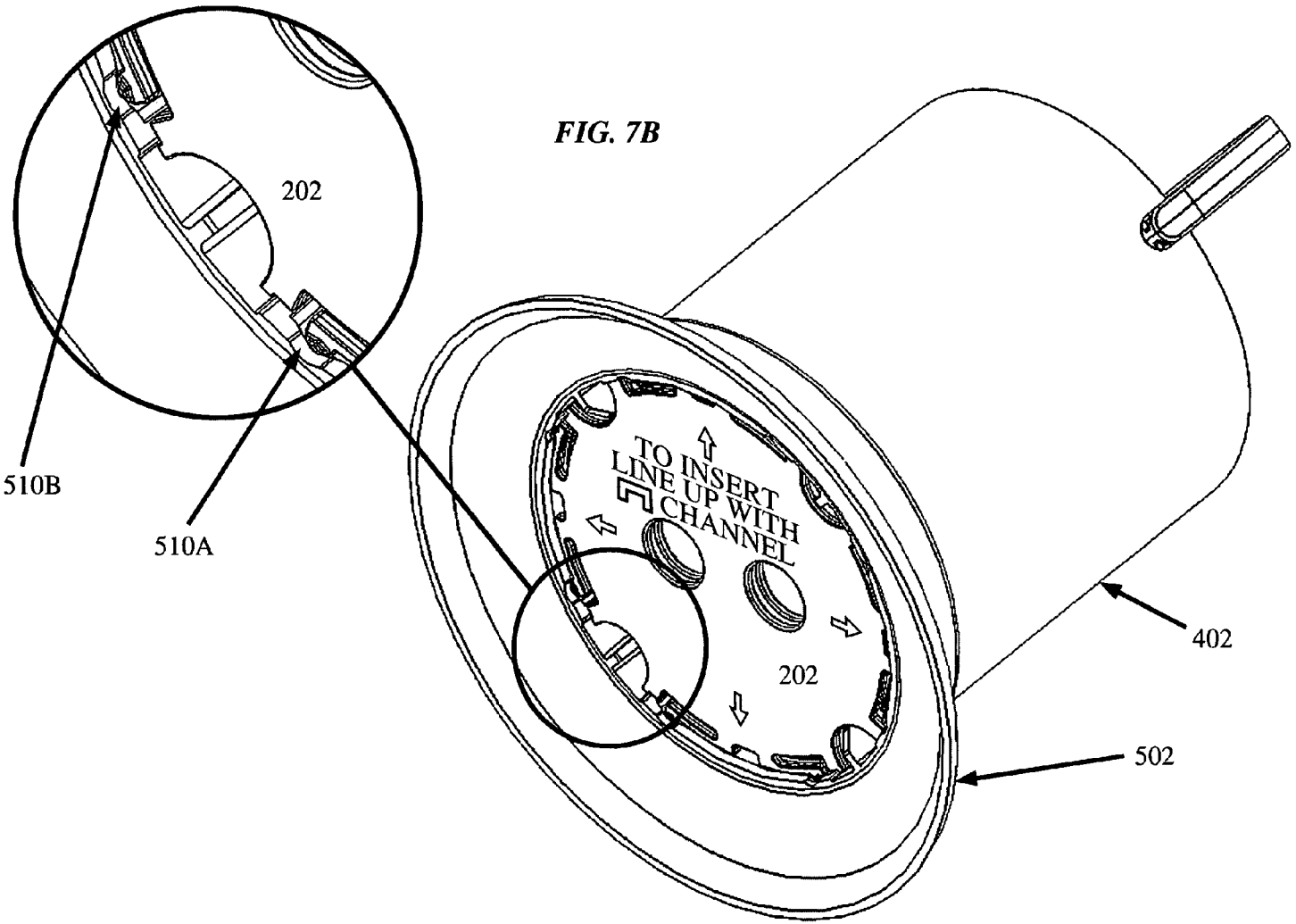
FIG. 7B shows a bottom perspective view of the base.
Figure 7C:
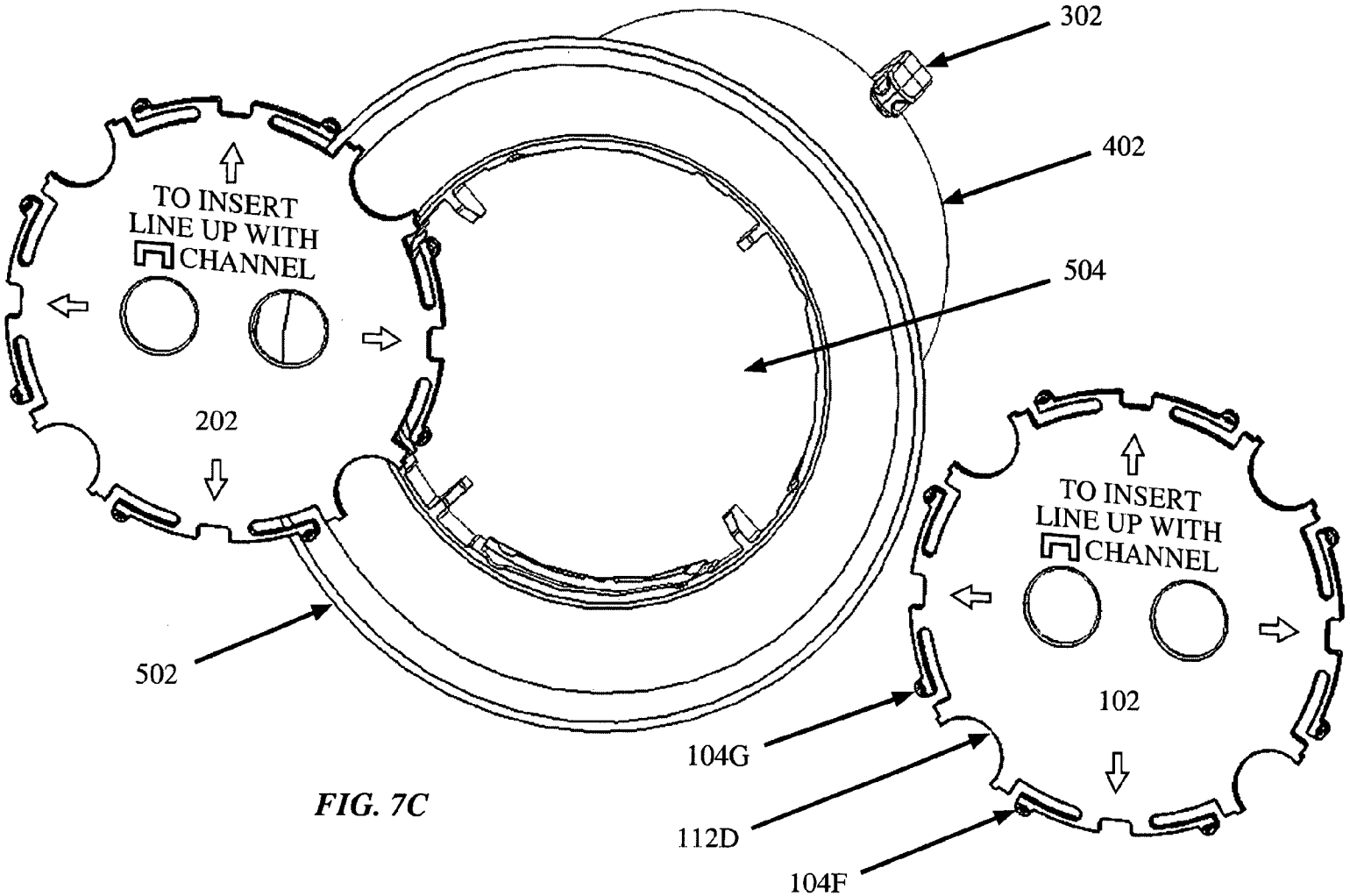
FIG. 7C shows a disassembled view of the embodiment of FIG. 7A.

FIGS. 6A through 6C show a preferred embodiment of an assembled accessory, with both discs 102, 202 inserted horizontally into the canister 402. It should be appreciated, as shown in FIGS. 8A through 8F, that a single disc 102 (or 202) can be used for a single yarn source, rather than having to insert both discs 102, 202. As shown in FIGS. 6A through 6C, when the base 502 and the canister 402 define a chamber (or cavity) in which one or more yarn sources can be inserted, so that the yarn can be dispensed from the chamber. It should be appreciated that, while the current embodiments show the chamber as being defined by the mating of two components (base 502 and canister 402), the chamber can be defined by a single, unitary structure that integrates the base 502 with the canister 402. In other words, the accessory need not be fabricated from two separate components (base 502 and canister 402), but may be fabricated as an integrated, single component. Also, while the current embodiments show the cavity (or chamber) being separated into multiple sub-chambers (or sub-cavities) using the substantially-circular discs 102, 202, it should be appreciated that other dividers can be used to create the needed sub-chambers.

FIGS. 8A through 8F and 9A through 9F show several embodiments of the accessory as it is dispenses one or more yarns 1004, 1006, 1104, 1106, 1204, 1206, 1304, 1306 from one or more yarn sources 1002, 1102, 1202, 1302.

Having identified each of the individual components of the accessory, the interplay between each of the components is described in greater detail below.

One embodiment of the accessory shows a canister 402 in which the project yarns are placed, base 502 attached to the bottom of canister 402 that provides stability and storage for discs 102 and 202 when not in use, a handle 302, and two, substantially identical, interchangeable discs 102 and 202. Plastic manufacturing processes can be used to create the canister 402, base 502, handle 302, and discs 102 and 202. For some example, but not limiting, embodiments, the canister 402 can be transparent or semi-transparent to show the yarn that is being used in the accessory. In other embodiments, the canister 402 can be opaque, with a solid color or patterned outside for aesthetic purposes. Similarly, for some but not limiting embodiments, the base 502, handle 302, and discs 102, 202 can be semi-transparent or opaque to suit the tastes of the craftsperson. In other embodiments, the base 502, handle 302, and discs 102, 202 can be transparent to match the canister 402, should the canister 402 be manufactured as a transparent item.

Discs 102 and 202 can fit inside canister 402 horizontally to create adjustable shelves to separate plural yarn ball (or skein) sources. Disc 102 or 202 can also fit inside canister 402 vertically as a divider to hold plural yarn skein (or ball) sources separately and upright. When not in use, discs 102 and 202 can be snapped into the base 502 bottom storage area 512.

Figure 9A:
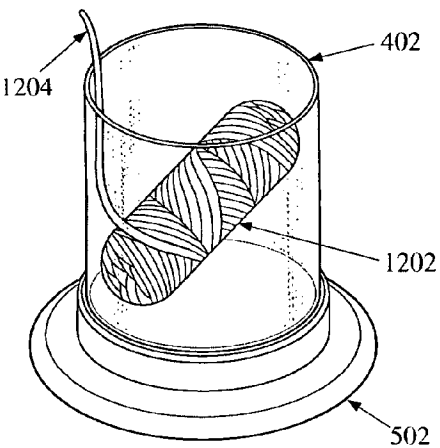
FIG. 9A shows a side perspective view of an embodiment with yarn skein external feed.
Figure 9B:
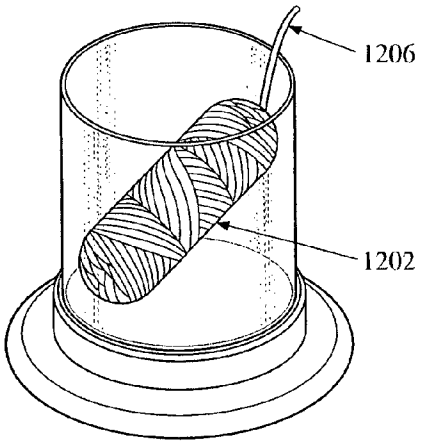
FIG. 9B shows a side perspective view of an embodiment with yarn skein internal feed.
Figure 9C:
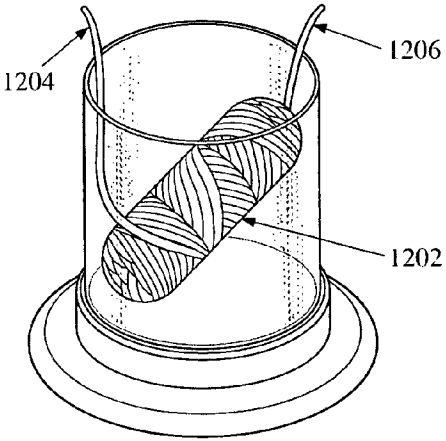
FIG. 9C shows a side perspective view of an embodiment with yarn skein external and internal feeds.
Figure 9D:
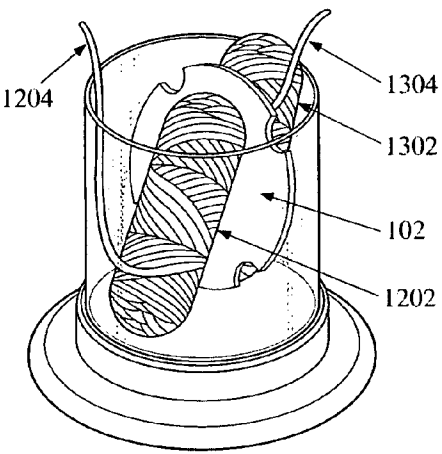
FIG. 9D shows a side perspective view of an embodiment with two yarn skeins, each with external feeds.
Figure 9E:
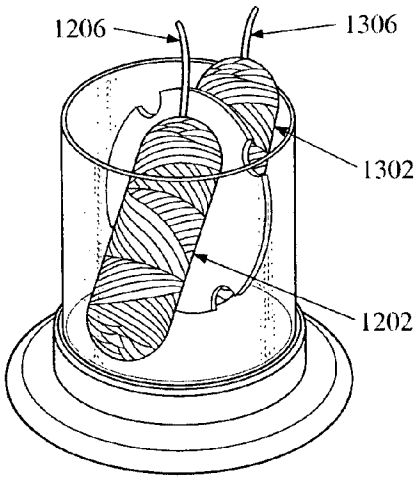
FIG. 9E shows a side perspective view of an embodiment with two yarn skeins, each with internal feeds.
Figure 9F:
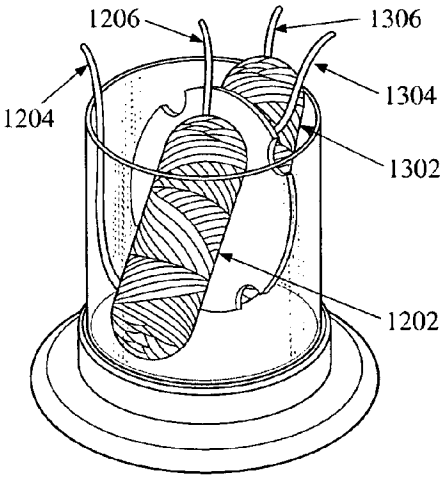
FIG. 9F shows a side perspective view of an embodiment with two yarn skeins, each with an external and an internal feed.

In a preferred embodiment, inside the canister 402, the surface is designed with four sets of five vertical channels 404, 406, and 408 located at approximately equal intervals around the interior periphery. Center channel 404 (404A, 404B, 404C and 404D) holds disc 102 (or 202) in place when inserted in the vertical position to divide canister 402. When used in the vertical position, disc 102 (or 202) slides into channels 404A and 404C (or 404B and 404D) located on diametrically opposite sides of canister 402. For this embodiment, none of the remaining vertical channels 404B and 404D (or 404A and 404C), 406, 408 are used when the present disclosure is configured with a disc vertical divider as shown in FIGS. 9D, 9E and 9F.

Center channel 404 can also act as the guide for inserting discs 102 and 202 in the horizontal position. There are four sets of five disc components: ball-shaped ends 104, notches 108, and extruding components 110 (collectively referred to herein as components 104, 108, 110). These components 104, 108, 110 are preferably located at approximately equal intervals around the periphery of disc 102 (202) corresponding to the four sets of components located along the inside of canister 402. Instruction and arrow 116 (216) guide the craftsperson to insert disc 102 (202) with disc notch 108 (208) matching canister 402 center channel 404. When disc notch 108 (208) is fit over canister 402 center channel 404, the remaining disc component pairs 104 (204) and 110 (210) automatically align respectively with canister 402 component pairs 406 and 408. The canister 402 component pairs 406 are 406H and 406A, 406B and 406C, 406D and 406E, 406F and 406G. The canister 402 component pairs 408 are 408H and 408A, 408B and 408C, 408D and 408E, 408F and 408G.

One embodiment of disc 102 (202) includes the tension bar arm designed in four sets of pairs 106A and 106B (206A and 206B), 106C and 106D (206C and 206D), 106E and 106F (206E and 206F), and, 106G and 106H (206G and 206H). Each arm ends with a ball shape respectively 104A and 104B (204A and 204B), 104C and 104D (204C and 204D), 104E and 104F (204E and 204F), and, 104G and 104H (204G and 204H). The ball end 104 (204) pairs slide up and down in the respective canister shallow, trough-shaped 406 pairs to hold disc 102 (202) in the horizontal orientation placement determined by the craftsperson.

The tension bar arm 106 (206) is flexible to provide the tension necessary to hold the disc 102 (202) placed by the craftsperson at the determined horizontal location. This embodiment ensures that each yarn source is isolated in an area adequate to support the innate movement of the yarn source and maintain the separation of each yarn source feed to prevent tangling of the separate yarn sources when yarn is pulled by the craftsperson. The flexible arms 106 (206) enable the disc 102 (202) to be slipped into canister U-shaped channel 404 for a vertical divider and to be snapped into the base storage area 512.

An embodiment of canister 402 includes the stop-guard channel 408 designed to keep the thread or yarn within the respective punch-out area (or opening) 112 (212) as it is being pulled. Each stop-guard channel 408 is L-shaped and makes up the last of the five elements in the four sets of vertical channels 404, 406, and 408 located at approximately equal intervals around the interior periphery of canister 402.

Each of the four sets of vertical channels 404, 406 and 408 located around the interior periphery of canister 402 corresponds to a respective set of disc 102 (202) components 104 (204), 108 (208), 110 (210). The four disc component sets 104 (204), 108 (208), 110 (210) are separated by four, semi-circular punch-out areas 112 (212) through which the yarn is run. Firmly woven yarn diameter up to one inch and novelty yarns in excess of two inches can be pulled unimpeded through punch-out areas 112 (212).

With disc 102 (202) inserted into canister 402 in the horizontal position, there is a stop-guard channel 408 located on either side of each punch-out area 112 (212) and keeps the yarn from sliding out of the containment area and getting caught in the tension bar arm 106 (206). The stop-guard 408 on one side of the punch-out area 112 (212) is the outside channel of one set of four vertical channels 408A, 408C, 408E, and 408G. The stop-guard 408 on the other side of the punch-out 112 (212) is the outside channel of a different set of four vertical channels 408B, 408D, 408F, and 408H.

Correspondingly, an embodiment of disc 102 (202) includes the stop-guard notch 110 (210) that slides against canister L-shaped channel 408 when disc 102 (202) is inserted in canister 402 in the horizontal position. The stop-guard notch 110 (210) is located on either side of a punch-out 112 (212) and keeps the yarn from sliding out of the containment area and getting caught in the tension bar arm 106 (206). The stop-guard notch 110 (210) on one side of the punch-out is the outside component of one set of four disc components 110B, 110D, 110F, and 110H. The stop-guard notch 110 (210) on the other side of the punch-out is the outside component of a different set of four disc components 110A, 110C, 110E, and 110G.

Another embodiment, among others, of disc 102 (202) includes two holes 114A (214A) and 114B (214B) located in the center area. The craftsperson can insert a finger in each hole 114A and 114B when removing or inserting disc 102 or 202 into the bottom storage area 512 or the canister 402.

Handle 302 elements 304A and 304B snap into canister 402 through holes 410A and 410B. Handle 302 rests along the outside of canister 402 when handle 302 is not in use. Handle 302 swings upright when in use. Snap 304A (304B) can be squeezed and pushed back out through hole 410A (410B) to be removed.

Preferably, base 502 fits on the bottom of canister 402 and is held into place by four brackets 506A, 506B, 506C and 506D located at equal intervals around base 502. When in place, base plate 504 forms the bottom of canister 402 and is the bottom shelf on which yarn source(s) rest.

One embodiment, among others, of base 502 provides a lower center of gravity to stabilize the accessory to remain upright and resist the torsional or lateral forces caused by the yarn sources as they unravel or pull.

Another embodiment, among others, includes base storage area 512 into which discs 102 and 202 can be snapped when not in use.

Figure 5A:
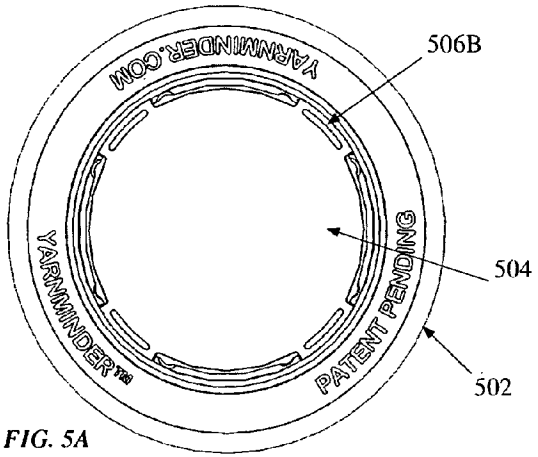
FIG. 5A shows a top view of a base disclosing selected components.
Figure 5B:
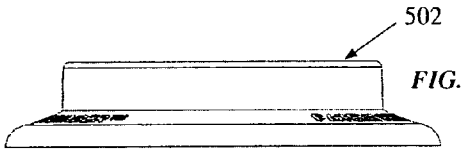
FIG. 5B shows a side view of the base.
Figure 5C:
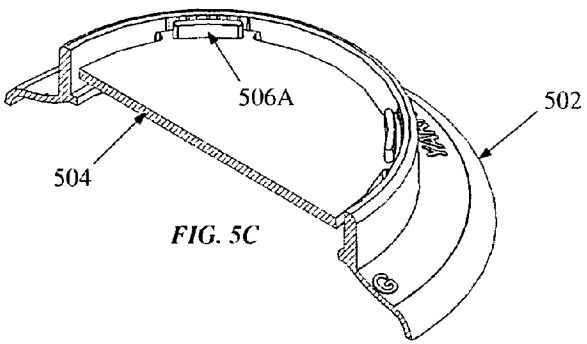
FIG. 5C shows a perspective cross-section view of the base.
Figure 5E:
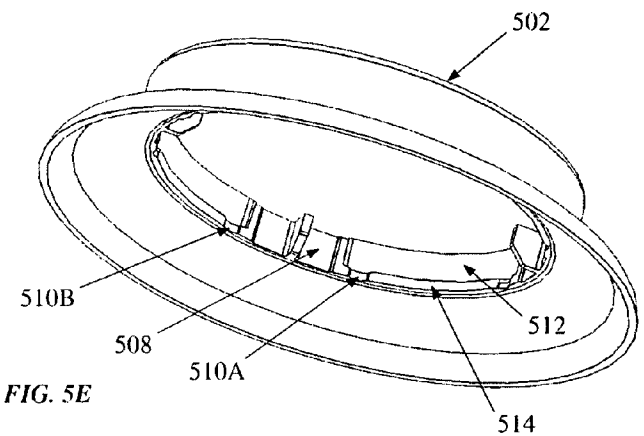
FIG. 5E shows a bottom perspective view of the base.
Figure 5D:
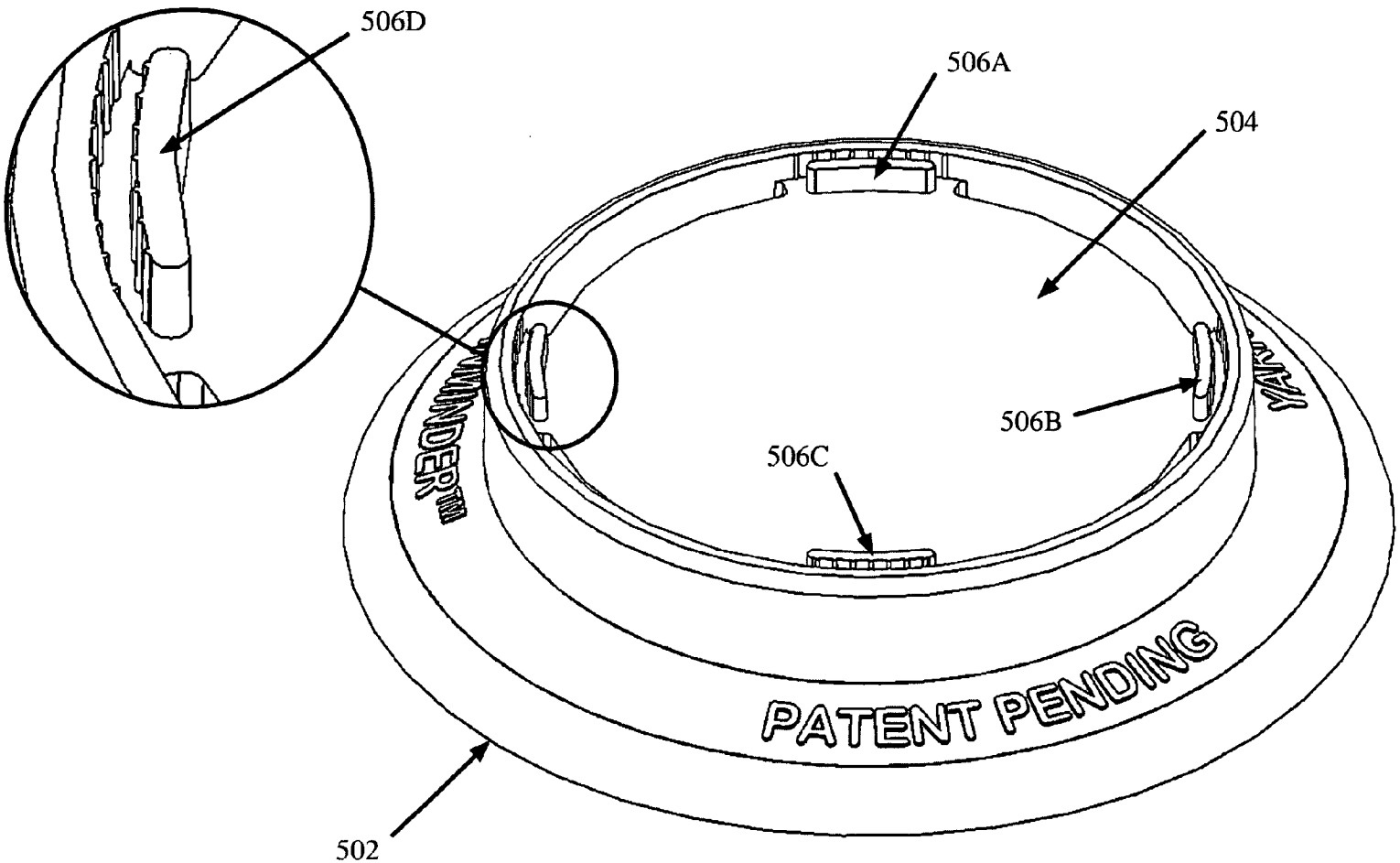
FIG. 5D shows a perspective view of the base showing selected components with a close-up view of one component called-out.

In yet another embodiment, among others, disc tension bar ball end 104 (204) snaps into base storage area 512. As illustrated in FIG. 7 and FIG. 5E, disc tension bar ball end 104F snaps into base channel 510A and ball end 104G is matched with 510B. The flexibility of disc tension bar arm 106 allows ball end 104 to squeeze beyond base ridge 514 and snap into storage cavity 512. Base embodiment 508 fits against disc embodiment 110 to keep the disc in place. Disc finger holes 114 (214) are used to pull disc 102 (202) in reverse action to unsnap respective disc and remove from base storage area 512.

With respect to FIGS. 8 and 9, it is the craftsperson's choice which configuration will be used for a specific project. The twelve configurations illustrated are given as "examples" herein are intended to be non-limiting.

One embodiment, among others, of the present invention automatically aligns disc punch-out 112 and 212. The four disc punch-out areas 112A, 112B, 112C, and 112D (212A, 212B, 212C, and 212D) will consistently be located in the same relative position to the four sets of channel embodiments of canister 402. These embodiments re-enforce learned behavior predictability for the craftsperson to become proficient at draping each yarn source over the canister 402 and having such placement be within a punch-out area 112 (212). This predictability reduces the probability of frustration experienced when lining up each yarn source to be aligned with the respective punch-out area 112 (212).

Figure 8A:
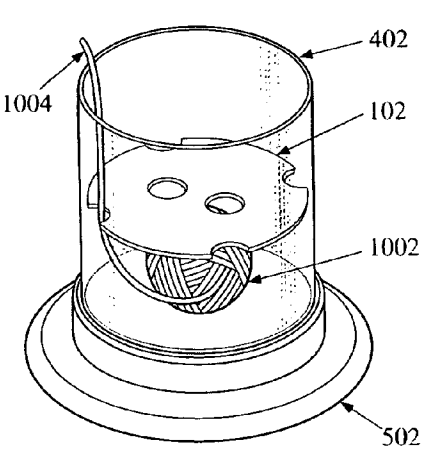
FIG. 8A shows a side perspective view of an embodiment with yarn ball external feed.
Figure 8B:
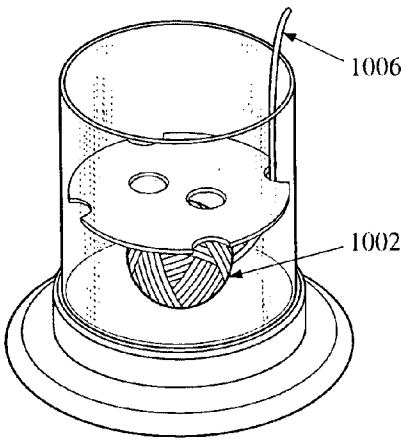
FIG. 8B shows a side perspective view of an embodiment with yarn ball internal feed.
Figure 8C:
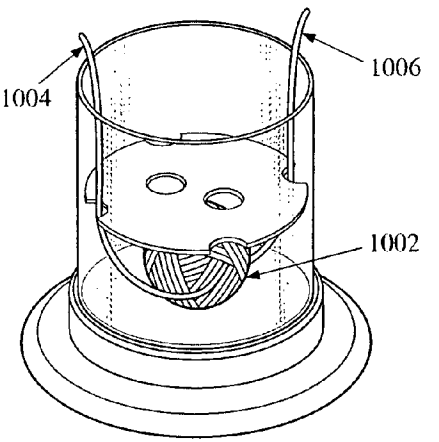
FIG. 8C shows a side perspective view of an embodiment with yarn ball external and internal feeds.

FIGS. 8A, 8B and 8C illustrate three possible configurations of a single ball yarn source 1002. FIG. 8A is a placement of yarn feed 1004 from the external ball winding. Yarn source 1002 could be configured by the craftsperson with yarn feed 1006 from the internal of the yarn ball. A third configuration (FIG. 8C) of yarn source 1002 is shown with both feed 1004 from the external ball winding and feed 1006 from the internal. This embodiment, among others, keeps each yarn feed separated by placement through respective punch-out 112. Another embodiment, among others, lets the horizontal placement of disc 102 (202) at a distance above yarn ball 1002 to ensure that each yarn source is isolated in an area adequate to support its innate movement yet still maintain the separation of each yarn source feed to prevent tangling when the separate sources are pulled by the craftsperson.

Figure 8D:
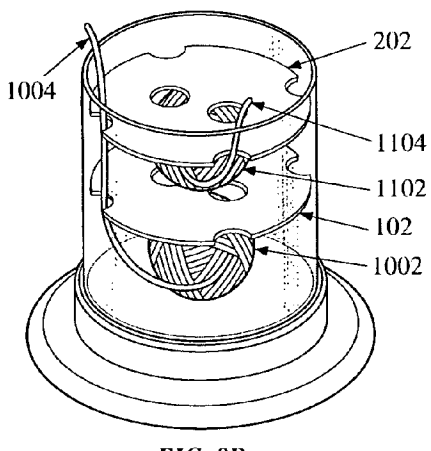
FIG. 8D shows a side perspective view of an embodiment with two yarn balls, each with external feeds.
Figure 8E:
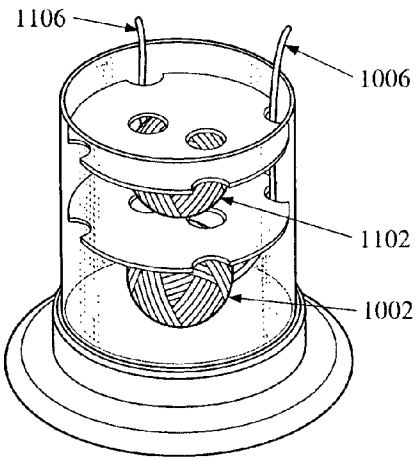
FIG. 8E shows a side perspective view of an embodiment with two yarn balls, each with internal feeds.
Figure 8F:
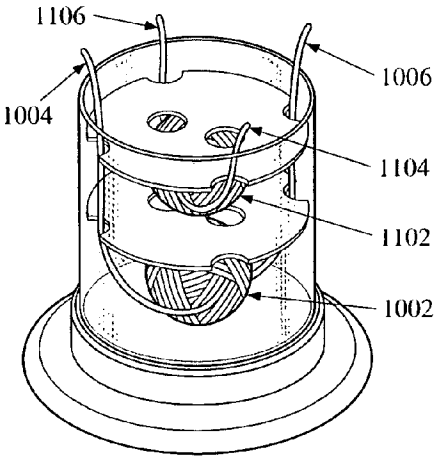
FIG. 8F shows a side perspective view of an embodiment with two yarn balls, each with external and internal feed.

FIGS. 8D, 8E and 8F illustrate parallel configurations to 8A, 8B and 8C with a second ball yarn source 1102. FIG. 8D illustrates ball yarn sources 1002 and 1102 each configured respectively with yarn feed 1004 and 1104 from the external ball winding. FIG. 8E illustrates ball yarn sources 1002 and 1102 each configured respectively with internal yarn feeds 1006 and 1106. The third configuration (FIG. 8F) illustrates ball yarn sources 1002 and 1102 each shown with external feeds 1004 and 1104, and internal feeds 1006 and 1106 respectively for a total of four yarn source feeds. This embodiment, among others, keeps each yarn feed separated by placement through respective punch-outs 112 (212). FIGS. 9A-9F parallel FIGS. 8A-8F with the exception FIGS. 9A-9F are shown using skein yarn source(s) and disc 102 (202) is positioned to divide canister 402 vertically.

The craftsperson knowledgeable in the art of knitting or crocheting will use the present disclosure to manage one or more yarn sources used in the creation of a project. The present disclosure is designed to separate the yarn sources and reduce the tangling of the yarn as the craftsperson progresses through a project.

Although exemplary embodiments have been shown and described, it will be clear to those of ordinary skill in the art that a number of changes, modifications, or alterations to the disclosure as described may be made. All such changes, modifications, and alterations should therefore be seen as within the scope of the disclosure.

What is claimed is:

1. An apparatus for managing yarn, the apparatus comprising:

(a) a substantially-cylindrical canister body having a diameter, an inside, an outside, an upper section, and a lower section, the canister body comprising:

(a1) a first channel located inside the canister body, the first channel extending axially downward from the upper section of the canister body to the lower section of the canister body;

(a2) a second channel located inside of the canister body, the second channel extending axially downward from the upper section of the canister body to the lower section of the canister body, the second channel being located at a position that is substantially diametrically opposite of the first channel; and (a3) a hole located in the upper section of the canister body, the hole configured to receive a handle;

(b) a disc having a diameter that is substantially identical to the diameter of the canister body, the disc being configured to insert into the inside of the canister body, the disc further being configured to divide the canister body into a plurality of compartments, the disc comprising:

(b1) a tension bar configured to apply tension in a direction that is radially outward from the center of the disc; and (b2) openings located around the periphery of the disc;

(c) a base configured to mate with the lower section of the canister body, the base further being configured to store the disc; and (d) a handle configured to mate with the hole in the upper section of the canister body.

2. The apparatus of claim 1, the disc being configured to vertically insert into the first channel and the second channel of the canister body.

3. An apparatus, comprising:

a canister, the canister being substantially cylindrical, the canister having a canister channel located on an inside wall of the canister;

a divider configured to insert into the canister, the divider comprising an opening, the opening configured to channel through yarn from a yarn source, the divider being a disc, the disc being configured to insert horizontally into the canister, the disc having a notch on the periphery of the disc, the notch being configured to slidably mate with the canister channel during horizontal insertion of the disc into the canister; and a base configured to mate with the canister to define a chamber, the chamber configured to hold the yarn source, the base having a storage compartment to store the divider, the storage compartment of the base having a base channel, the base channel being configured to mate with the notch during storage of the disc in the storage compartment.

* * * * *